United States Patent [19]

Yoneda

[11] Patent Number: 4,702,152

[45] Date of Patent: Oct. 27, 1987

[54] METHOD OF MANUFACTURING AN IGNITION FILE FOR A LIGHTER

[76] Inventor: Yushin Yoneda, 1788, Mebuki, Noda, Japan

[21] Appl. No.: 910,813

[22] Filed: Sep. 23, 1986

Related U.S. Application Data

[63] Continuation of Ser. No. 689,974, Jan. 9, 1985, abandoned.

[51] Int. Cl.[4] ..... B21K 5/00

[52] U.S. Cl. ..... 72/338; 72/324; 72/356; 72/359

[58] Field of Search ..... 72/327, 326, 325, 333, 72/334, 335, 356, 358, 359, 338, 324; 10/86 F

[56] References Cited

U.S. PATENT DOCUMENTS

| | | | |
|---|---|---|---|
| 1,384,118 | 7/1921 | Blakeslee | 10/86 F |
| 2,080,850 | 5/1937 | Frayer | 10/86 F |
| 2,342,021 | 2/1944 | Swanson | 72/327 |
| 2,393,850 | 1/1946 | Wilcox | 10/86 F |
| 2,689,360 | 9/1954 | Ware | 10/86 F |
| 3,169,257 | 2/1965 | Loos et al. | 10/86 F |
| 3,347,080 | 10/1967 | Bailey et al. | 72/334 |
| 3,793,658 | 2/1974 | Ladouceur | 10/86 F |
| 4,290,292 | 9/1981 | Yoneda | 72/330 |

FOREIGN PATENT DOCUMENTS

| | | | |
|---|---|---|---|
| 714670 | 12/1941 | Fed. Rep. of Germany | 72/358 |
| 626458 | 7/1949 | United Kingdom | 10/86 F |

*Primary Examiner*—Daniel C. Crane
*Attorney, Agent, or Firm*—Holman & Stern

[57] ABSTRACT

This invention relates to a method of manufacturing an ignition file for a lighter by a press and a device therefor, more particularly to an improvement of a punching operation of an axial hole for mounting an ignition file. A material pressed into a disk-like configuration is prepared and a concave portion is provided in the approximate center of both sides of the file member. A hole is punched between concave portion having a diameter smaller than that of the concave portion. The fin of the file member caused by punching is absorbed in a gap provided inside the die wall while the fin projecting toward the die hole to be punched is absorbed in said concave portion.

1 Claim, 14 Drawing Figures

METHOD OF MANUFACTURING AN IGNITION FILE FOR A LIGHTER

This is a continuation of application Ser. No. 689,974, filed Jan. 9, 1985, now abandoned.

BACKGROUND OF THE INVENTION

This invention is an improvement of the invention of U.S. Pat. No. 4,290,292.

This invention particularly aims at improving the process of boring an axial hole for ignition files for a lighter in accordance with U.S. Pat. No. 4,290,292.

The present invention is an improvement of the invention of U.S. Pat. No. 4,290,292 not only with regard to said hole but also the press device for molding the hole.

The invention disclosed under U.S. Pat. No. 4,290,292 describes in detail a process for preparing an ignition file for a lighter by a press.

SUMMARY OF THE INVENTION

Having manufactured said ignition lighter by press, the inventor of U.S. Pat. No. 4,290,292 has improved that U.S. Pat. No. 4,290,292 in several points.

One of the improvements is that a part of the steps for pressing a file can be omitted or merged into the rest by improving the press.

Another improvement is to set the diameter of the hole for a file to be pressed uniform.

The third improvement is to prevent the file hole punched by the press, particularly the area where the punch exists, from becoming peeled off or chipped off by the pressure of the punch.

The fourth improvement is to provide molding of a file member free from distortion by eliminating difficulty in drawing out the punch when the file hole is punched by a press.

The fifth improvement is to provide a curvature approximating taper in the peripheral edge of the face where the teeth of file member are cut to prevent flashes in the periphery of the teeth and also to provide molding operation with better machinability (of ignition stone).

In order to achieve above improvements, the present invention modifies the configuration of the punch and the die hole on the file member, and restricts the number of presses used successively for pressing. The present invention also provided a difference (in diameter) between the concaved portion in the file member provided in advance for punching the hole and the diameter of the axial hole actually punched. In other words, a punch with a smaller rod diameter than that of the concaved portion is used to provide a certain dimensional difference between the diameter of the concaved portion and that of the hole actually punched.

The above mentioned purposes 1 through 5 are achieved in the molding steps of the file according to the present invention.

The molding step of the file according to this invention will now be described in detail hereinunder.

DETAILED DESCRIPTION OF THE INVENTION

Figure 1:
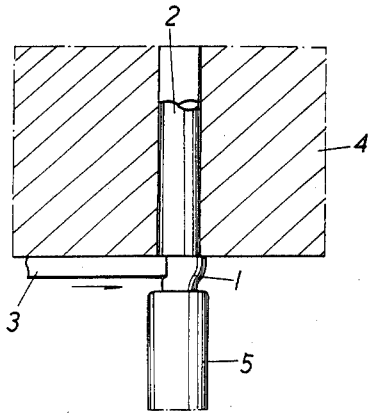
FIG. 1 is a partial cross sectional view illustrating a state where the file member is forcibly cut by a cutter from the wire rod.
Figure 2:
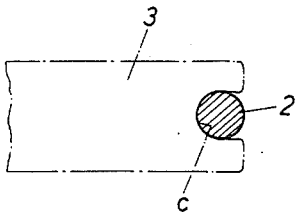
FIG. 2 is a partial cross sectional view showing one embodiment of a cutter.
Figure 3:
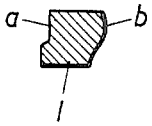
FIG. 3 is a cross sectional view showing the configuration of the file member which is cut.

A file member 1 is obtained by cutting a wire rod 2 (generally called a coiled material) with a cutter 3. The reference number 4 denotes a cutter die which guides the wire rod 2 while 5 denotes a thrust member, etc. of the wire rod 2 which presses and cuts the wire rod 2 to obtain the desired thickness of the file. As shown in FIG. 3, the wire rod 2 thus cut is concaved on the face a which is pressed by the cutter 3 and convexed on the opposite face b showing a distorted configuration. Therefore, the thrust face c (shown in FIG. 2) is provided in the cutter 3 to match the curve of the wire rod 2 as shown by the chain-and-dot line in order to prevent said distortion.

Figure 4:
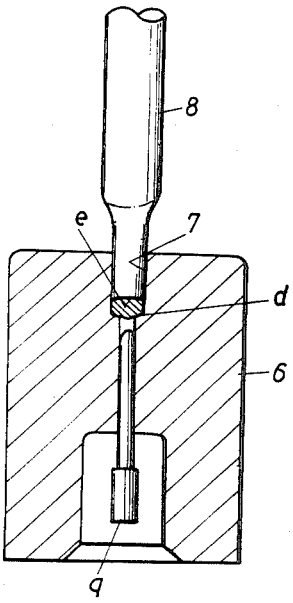
FIG. 4 is a partial cross sectional view illustrating a state of press for modifying the configuration of the file member which is forcibly cut.

The file member 1 thus cut is placed in a die hole 7 (as seen in FIG. 4) having a diameter larger than that of the file member 1 and pressed with a punch 8.

Figure 6:
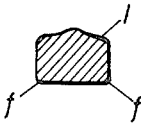
FIG. 6 is a cross sectional view of the file member with its configuration modified.
Figure 8:
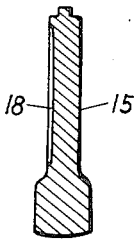
FIG. 8 is a cross sectional view of a one-way punch.

At this time a curved face d is provided on the bottom face of the hole 7 of the die 6 so as to flatten or slightly depress the center of the face e at which the punch 8 strikes to prepare the file member 1 as shown in FIG. 4 and in FIG. 6.

Figure 5:
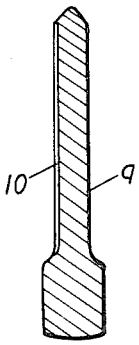
FIG. 5 is a cross sectional view of a projection pin.
Figure 7:
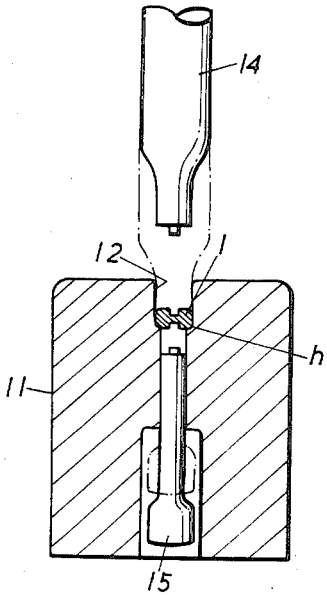
FIG. 7 is a partial cross sectional view illustrating the pressed state of a concaved portion to be punched in the file member.

In the press operation the air in the die hole 7 is released from a groove 10 (shown in FIG. 5) of a projection pin 9 in order to have the file member 1 expand against the face d of the die 6 and to give curvature f (shown in FIG. 6) in the file member 1.

The file member 1 thus partially modified of its contour is placed in a hole 12 of a second die 11 and a concave 13 (shown in FIG. 4) is press formed on both sides of the disc shaped file member 1.

A top punch 14 and a bottom punch 15 are used in the press operation to form concaves 13, 13 on both sides of the file member 1 inserted into the die hole 12.

Figure 9:
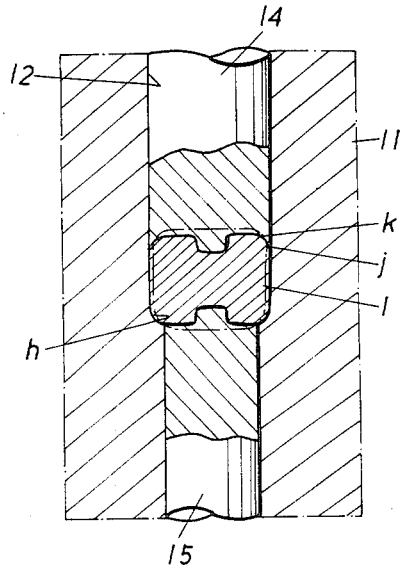
FIG. 9 is an enlarged cross sectional view of the critical part of FIG. 7.
Figure 10:
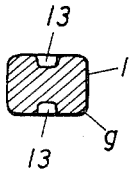
FIG. 10 is a cross sectional view of the file member in which concaved portions are provided.

A curvature h corresponding to a curvature g (as seen in FIGS. 9 and 10) provided on the periphery of the file member 1 is provided on the bottom of the die hole 12 so that the area except the curvature h is occupied by the bottom punch 15.

Figure 11:
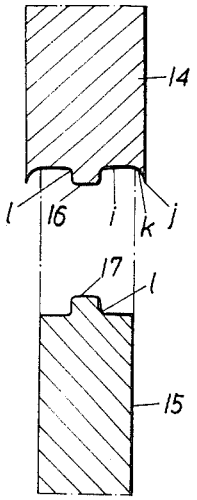
FIG. 11 is an enlarged cross sectional view of the punch in FIG. 7.

The top punch 14 has a rod diameter which allows sliding insertion of the rod into the die hole 12 and periphery of its thrust face i is raised, as seen in FIG. 11.

A curvature k (as seen in FIG. 11) corresponding to said curvature g is provided projectingly from its periphery j toward the thrust face i.

Projections 16, 17 with their base l expanded are provided in the center of the top punch 14 and the bottom punch 15 respectively so as to provide concaves 13, 13 on both sides of the file member 1.

The embodiment shown in FIG. 9 illustrates the press operation. The file member 1 shown by the broken line is placed into the die hole 12 having a diameter larger than that of the file member 1. The top and the bottom punches 14, 15 are then operated to press the file member 1 shown in broken lines to the extent indicated by solid lines and thus pressure-weld the same in the die hole 12 to form concaves on both sides.

As a result the file member 1 having a precise curvature g in the periphery is provided as shown in FIG. 10. In order to approximate the curvature g to a taper, the diameter of the bottom punch 15 is specified as mentioned above, and is projected beyond the curvature h of the die hole 12 in the press operation. As a result, the difficulty in providing a curvature h close to a taper in the bottom face of the die hole 12 is overcome and a curvature g of the file member 1 is approximated to a taper.

Similarly a slot 18 is provided in the bottom punch 15 to release the air in the die hole 12 so as to facilitate the precise forming of the file member 1.

Figure 12:
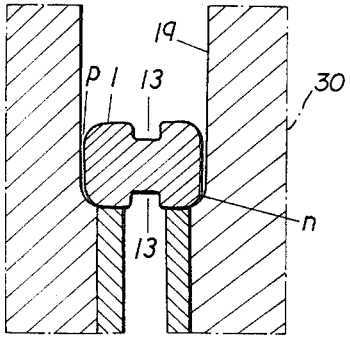
FIG. 12 is a cross sectional view of the state in which the file material is placed in a punching die.

Thus formed file member 1, as shown in FIG. 12, is placed into a die 20 having a die hole 19 having a diameter larger than that of the file member 1 to have the axial hole 20 punched out.

Figure 14:
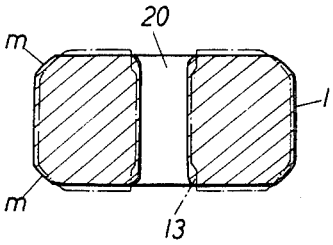
FIG. 14 is a cross sectional view of the file material in which an axial mounting hole is punched out.

A curvature n corresponding to a curvature m of the file member 1 is provided on the bottom of the die hole 19 so that the file member 1 is formed as shown in FIG. 14 when an axial hole 20 is bored by a punch 21.

Figure 13:
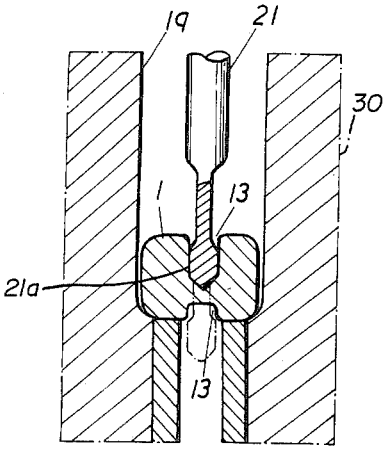
FIG. 13 is a cross sectional view showing in part the punched out state.

The diameter of the concave 13 of the file member 1 is made larger than that of the punch 21 to provide a hole 20 similar to the one shown in FIG. 13.

The reason for decreasing the rod diameter of the punch 21 will now be described by referring to FIGS. 12 through 14. FIG. 12 shows the relation between the file member 1 and the die hole 19 in the die 30 before punching with a punch 21. The punch 21 has an enlarged penetrating portion 21*a*. A gap p remains between the member 1 and the hole 19. When the punch 21 is moved as shown in FIG. 13, the member 1 expands to closely contact the wall of the die hole 19. When an axial hole 20 is completely punched out by further moving the punch 21, the member 1 also expands into the concave 13 as shown by solid line in FIG. 14 to reduce the concave 13 in area. In other words, the member is formed into a configuration shown by a solid line from that shown by a chain-and-dot line.

In an example of punching of the hole 20 as shown by a solid line, the diameter of the concave 13 is set at 2.55 $\phi$, the rod diameter of a punch 21 at 2.49 $\phi$, and said gap p at 0.33 mm respectively to obtain a file substantially same as the one shown in FIG. 14.

When the hole 20 of the above construction file member 1 must be given the same uniform size, the file member 1 punched as shown in FIG. 13 is inverted and the hole 20 is chamfered with another punch (not shown) having a diameter smaller than that of the punch 21 from the direction opposite to that of punching by the punch 21 to modify the hole dimension.

The file member 1 prepared as above is quenched and set with teeth to provide an ignition file for a lighter.

The following advantages are achieved by the present invention with the construction described as above.

(1) Compared to U.S. Pat. No. 4,290,292, less number of steps are required in production.

(2) The face m of the molded file member 1 is approximated to a taper in order to prevent flashes but without reducing the machinability.

(3) Punching by a punch 21 is facilitated. Although the file member 1 expands into the hole 20 to be punched out and makes the hole smaller, it is possible to draw out the punch 21 smoothly and securely.

(4) An axial hole 20 will have the substantially uniform diameter on the entrance and exit sides of the punch 21 so as to prevent the deviation in the revolution of the file member 1.

(5) Since a concave 13 is provided at the exit side of the punch 21 against the operation of the punch 21, no peeling off of the file member around the exit area occurs.

(6) Since the periphery of the file member is gradually expanded by several press operations, teeth are not likely to come off after quenching and setting operations.

Although preferred embodiments have been shown, it will be understood that the present invention is not limited thereto, but may be otherwise embodied within the scope of the following claims.

What we claim:

1. A method of manufacturing rotatable ignition files and flint wheels for lighters, comprising the steps of:

(a) cutting elongate wire stock of gauge appropriate to the desired diameter of the wheel into disk-shaped blanks of suitable size; each said blank having a top surface, a bottom surface, a central region, an outer diameter, and an outer periphery;

(b) applying a series of press operations to said blanks from step (a), as cut, by means of respective punches and dies to round off peripheral edges of said blanks of step (a) to provide axial mounting holes and to harden the respective surfaces of said blanks of step (a); said series of press operations including the steps of:

(b) (1) providing a first die having an opening therethrough, said opening being circumscribed by a first annular lip having a first curved surface for receiving said lower surface of said blank of step (a);

(b) (2) placing said lower surface of said blank of step (b) (1) against said first curved surface of said annular lip of said first die;

(b) (3) providing a first punch having a first punch face;

(b) (4) punching said top suface of said blank with said first punch face by passage of said first punch in said opening in said first die, to deform said blank of step (b) (2) to form a curved face on said bottom surface of said blank of step (b) (2) which conforms to said first curved surface on said first annular lip;

(b) (5) providing a second die having an opening therethrough, said opening having an enlarged portion and a narrower portion; said second die having a second annular lip at a juncture of said enlarged portion and said narrower portion, said second annular lip having a second curved surface for receiving said bottom surface of said blank of step (b) (4); said second annular lip bounding a lowermost portion of said enlarged portion of said opening of said second die; said enlarged portion of said second die in the vicinity of said second annular lip having a diameter larger than said outer diameter of said blank of step (b) (4) by a predetermined distance, to create a radial gap about said blank of step (b) (4) to permit expansion of said blank of step (b) (4) outwardly during a punching operation;

(b) (6) removing said blank of step (b) (4) from said first die and placing said blank of step (b) (4) within said opening of said second die such that said bottom surface of said blank of step (b) (4) contacts said second curved surface and is supported thereby;

(b) (7) providing a second punch for movement in said enlarged portion of said opening of said second die, and end of said second punch having a generally centrally located projection and a first curved peripheral surface surrounding said projection, said first curved peripheral surface being generally concave;

(b) (8) providing a third punch for movement in said portion of said opening of said second die, said third punch having an end having a generally centrally located projection and a second curved peripheral surface surrounding said projection of said third punch;

(b) (9) placing said end of said second punch against said top surface of said blank of step (b) (6) by movement of said second punch through said enlarged portion of said second die;

(b) (10) maintaining said second punch against said blank of step (b) (9) and placing said end of said third punch against said bottom surface of said blank of step (b) (9) by movement of said third punch through said narrower portion of said opening through said second die;

(b) (11) pressing said blank of step (b) (10) between said second and third dies to form a substantial reduction in thickness of said central region of said blank of step (b) (10), so as to form a central depression having a predetermined internal diameter on each of said top surface and said bottom surface of said blank of step (b) (10), thereby forming a curved surface on said top surface of said blank of step (b) (10) which conforms to said first curved peripheryal surface of said second punch, and thereby also forming a correspondingly curved surface on said bottom surface of said blank from step (b) (10) which conforms to said second curved peripheral surface of said third punch, thereby reducing the thickness of said central region of said blank of step (b) (10);

(b) (12) removing said second punch from said enlarged opening of said second die;

(b) (13) removing said blank of step (b) (11) from said second die;

(b) (14) providing a third die having an opening therein, said opening in said third die having a sidewall, an enlarged portion, a narrower portion, and a third annular lip at a juncture of said enlarged and narrower portions in said third die; said third annular lip being adapted for receiving said bottom surface of said blank of step (b) (13); said opening in said third die having an internal diameter which is larger by a predetermined distance than the diameter of said blank of step (b) (13) to permit expansion thereof and to create a radial gap thereabout, when said blank of step (b) (13) is resting on said third annular lip;

(b) (15) placing said blank of step (b) (12) within said opening in said third die such that said bottom surface of said blank of step (b) (13) contacts and is supported by said third annular lip of said third die;

(b) (16) providing a fourth punch having an enlarged penetrating end portion and a narrower neck portion, said enlarged penetrating end portion having a slightly smaller diameter relative to said predetermined internal diameter of said central depressions;

(b) (17) punching said top surface of said central region of said blank of step (b) (15) during a forward stroke of said fourth punch while said blank of step (b) (15) is disposed in said third die, causing resilient radial expansion of said blank of step (b) (15) radially outwardly until expansion of said blank of step (b) (15) radially is stopped by contact of said outer periphery of said blank of step (b) (15) with said sidewall of said opening in said third die;

(b) (18) continuing said forward stroke of said fourth punch until said enlarged penetrating end portion completely penetrates said blank of step (b) (17) to form a central opening having an internal sidewall through said blank of step (b) (17) and to chamfer said top surface adjacent said opening in said blank of step (b) (17);

(b) (19) continuing said forward stroke of said fourth punch until said enlarged penetrating end portion has passed completely through said central opening and said narrower neck portion is disposed within said central opening of said blank of step (b) (18), thereby permitting resilient restoration of said blank of step (b) (18) by radial contraction of said blank of step (b) (18) away from said sidewall of said opening in said third die and by radial expansion of said internal sidewall of said central opening in said blank of step (b) (18) toward said narrower neck portion of said fourth punch;

(b) (20) punching a bottom portion of said central region surrounding said central opening of said blank of step (b) (19) of said blank to chamfer said bottom surface of said blank of step (b) (19) adjacent said central opening.

* * * * *